US011097554B2

(12) United States Patent
Nakatani et al.

(10) Patent No.: US 11,097,554 B2
(45) Date of Patent: Aug. 24, 2021

(54) THERMAL PRINTHEAD AND METHOD OF MANUFACTURING THE SAME

(71) Applicant: Rohm Co., Ltd., Kyoto (JP)

(72) Inventors: Goro Nakatani, Kyoto (JP); Akira Fujita, Kyoto (JP); Kazuya Nakakubo, Kyoto (JP); Yasuhiro Fuwa, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 16/911,293

(22) Filed: Jun. 24, 2020

(65) Prior Publication Data

US 2021/0001641 A1 Jan. 7, 2021

(30) Foreign Application Priority Data

Jul. 3, 2019 (JP) ..... JP2019-124488

(51) Int. Cl.
*B41J 2/335* (2006.01)
*B41J 2/34* (2006.01)

(52) U.S. Cl.
CPC ..... *B41J 2/3359* (2013.01); *B41J 2/3354* (2013.01); *B41J 2/3357* (2013.01); *B41J 2/33515* (2013.01); *B41J 2/33535* (2013.01); *B41J 2/33545* (2013.01); *B41J 2/33595* (2013.01); *B41J 2/34* (2013.01)

(58) Field of Classification Search
CPC .. B41J 2/3359; B41J 2/33535; B41J 2/33515; B41J 2/3354; B41J 2/3357; B41J 2/33595; B41J 2/33545; B41J 2/34
See application file for complete search history.

(56) References Cited

U.S. PATENT DOCUMENTS 4,742,362 A * 5/1988 Takoshima ..... B41J 2/33525 338/308
2002/0158959 A1* 10/2002 Shirakawa ..... B41J 2/3353 347/202
2017/0182794 A1* 6/2017 Nishimura ..... B41J 2/3351

FOREIGN PATENT DOCUMENTS

JP 2007-269036 A 10/2007
JP 2019-14233 A 1/2019

* cited by examiner

*Primary Examiner* — Yaovi M Ameh
(74) *Attorney, Agent, or Firm* — Hamre, Schumann, Mueller & Larson, P.C.

(57) ABSTRACT

A thermal printhead includes a substrate, a protrusion formed on an obverse surface of the substrate and extending in a main scanning direction, a heat storage layer formed on a top surface of the protrusion, and a plurality of heat-generating parts arranged along the main scanning direction on the heat storage layer. The substrate and the protrusion are integrally formed from a single-crystal semiconductor.

16 Claims, 17 Drawing Sheets

A1

THERMAL PRINTHEAD AND METHOD OF MANUFACTURING THE SAME

FIELD

The present disclosure relates to a thermal printhead and a method for manufacturing thermal printheads.

BACKGROUND

JP-A-2007-269036 discloses a conventional thermal printhead. The thermal printhead includes a number of heat-generating parts on a head substrate arranged side by side in a main scanning direction. For forming each heat-generating part, a glaze layer is formed on the head substrate, and a resistor layer is formed on the glaze layer. On the resistor layer, an upstream electrode layer and a downstream electrode layer are disposed so that the ends of the electrodes face each other with parts of the resistor layer exposed between them. By passing an electric current between the upstream electrode layer and the downstream electrode layer, the exposed parts of the resistor layer (i.e., heat-generating parts) generates heat by Joule effect.

The conventional thermal printhead includes a convex glaze layer acting as a heat storage extending in the main scanning direction beneath the heat-generating parts. The convex glaze layer contributes to efficient heat transfer to a print medium and high-speed printing. The convex glaze layer also serves to improve the contact between the heat-generating parts and a platen roller and thus improve the quality of printing.

The convex glaze layer described above is typically formed by screen printing of glass paste, followed by baking the paste. However, with this method of forming the convex glaze layer by printing, the film thickness may vary from product to product or from location to location in the main-scanning direction within one product. This has made it difficult to provide a thermal printhead with uniform quality or uniform printing quality.

JP-A-2019-14233 also discloses a technique related to a thermal print head. The thermal print head has a protrusion formed on the head substrate by anisotropic etching of a single-crystal semiconductor. Heat-generating parts are formed on the protrusion. Although this technique can ensure that the protrusion has a uniform shape in the main-scanning direction, the protrusion is made of a single-crystal semiconductor, which has higher thermal conductivity than glass. It is therefore necessary to provide a measure for improving heat storage characteristics, without compromising the advantages of being able to form a uniformly shaped protrusion.

SUMMARY

In view of the circumstances noted above, it is an object of the present disclosure to provide a thermal printhead including a head substrate on which a protrusion is formed beneath heat-generating parts, while ensuring that the protrusion has the required heat storage characteristics.

According to an aspect of the present disclosure, there is provided a thermal printhead including: a substrate having an obverse surface; a protrusion formed on the obverse surface of the substrate and extending in a main scanning direction; a heat storage layer formed on a top surface of the protrusion; and a plurality of heat-generating parts arranged along the main scanning direction on the heat storage layer, where the substrate and the protrusion are integrally formed from a single-crystal semiconductor.

According to another aspect of the present disclosure, there is provided a method for manufacturing a thermal printhead that includes: a substrate having an obverse surface; a protrusion formed on the obverse surface of the substrate and extending in a main scanning direction; a heat storage layer formed on a top surface of the protrusion; and a plurality of heat-generating parts arranged along the main scanning direction on the heat storage layer, where the substrate and the protrusion are integrally formed from a single-crystal semiconductor. The method may include: forming a glaze layer of a predetermined thickness on an obverse surface of a material substrate of a single-crystal semiconductor; forming an intermediate glaze by subjecting the glaze layer to wet-etching, where the intermediate glaze has a predetermined width in a sub-scanning direction and extends in the main scanning direction; and forming the protrusion by anisotropic etching of the material substrate in a manner such that the protrusion has a top surface covered by the intermediate glaze.

Other features and advantages of the present disclosure will become more apparent from the detailed description given below with reference to the accompanying drawings.

DRAWINGS

EMBODIMENTS

Figure 1:
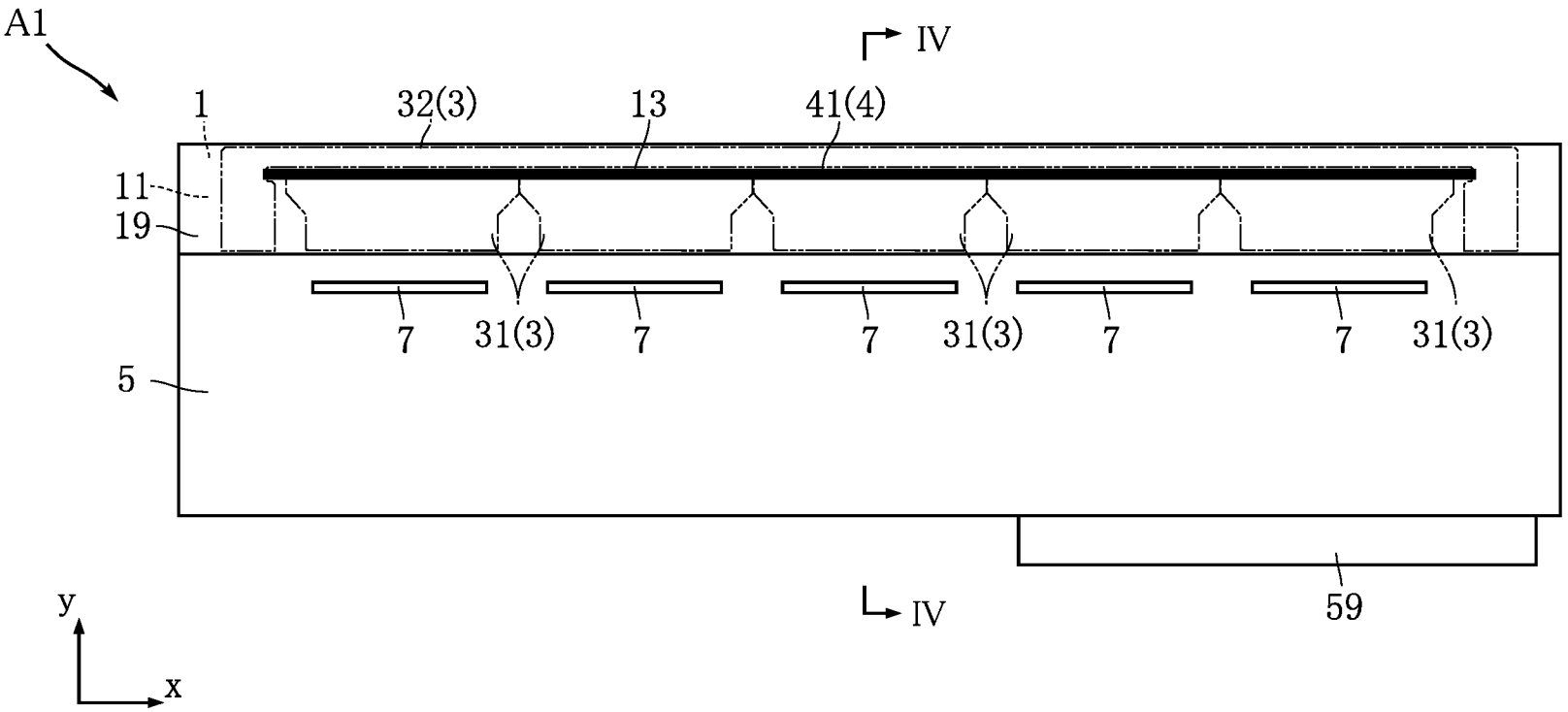
FIG. 1 is a plan view of a thermal print head according to one embodiment of the present disclosure.
Figure 2:
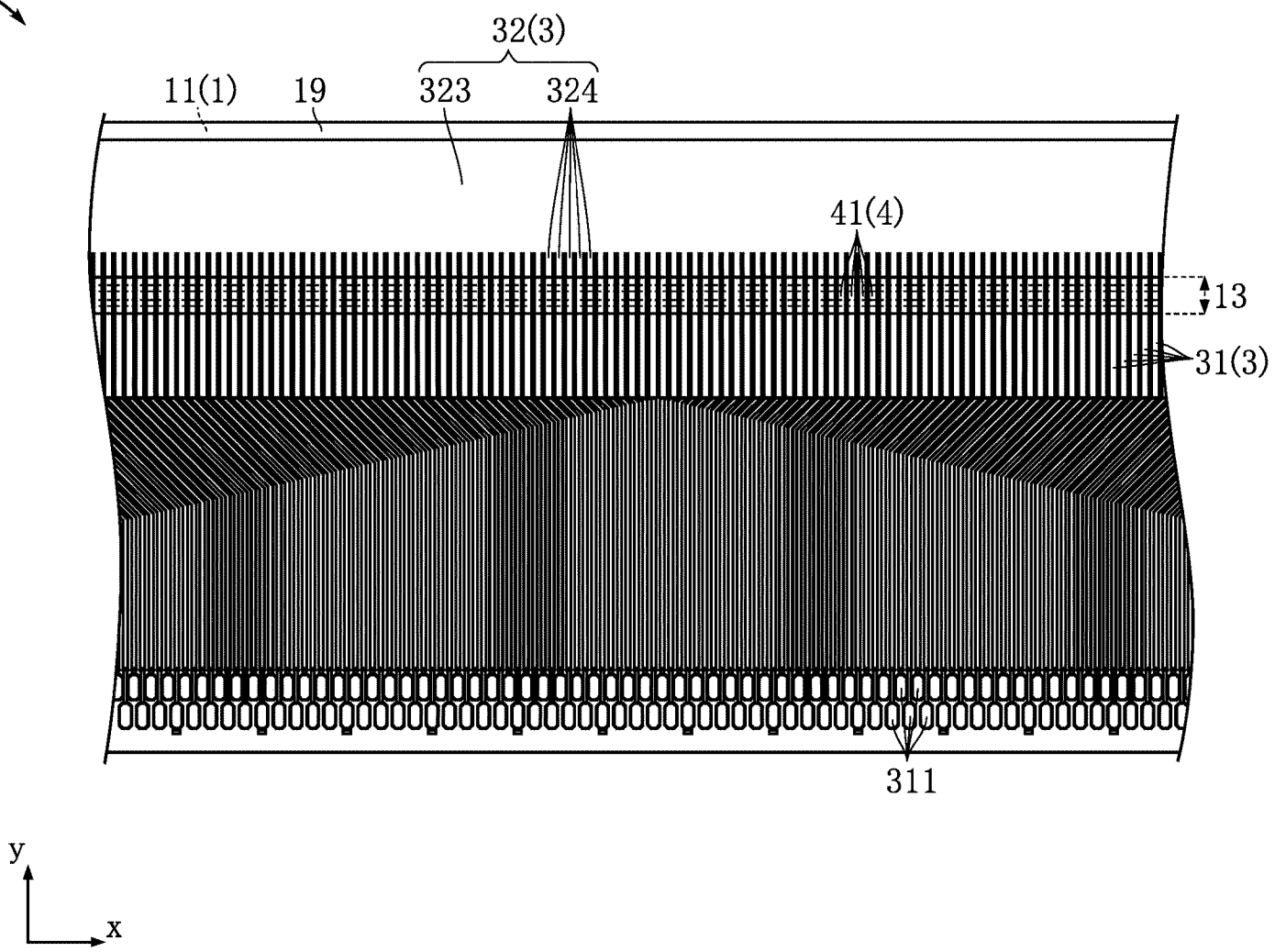
FIG. 2 is a plan view showing a part of a thermal print head according to one embodiment of the present disclosure.
Figure 3:
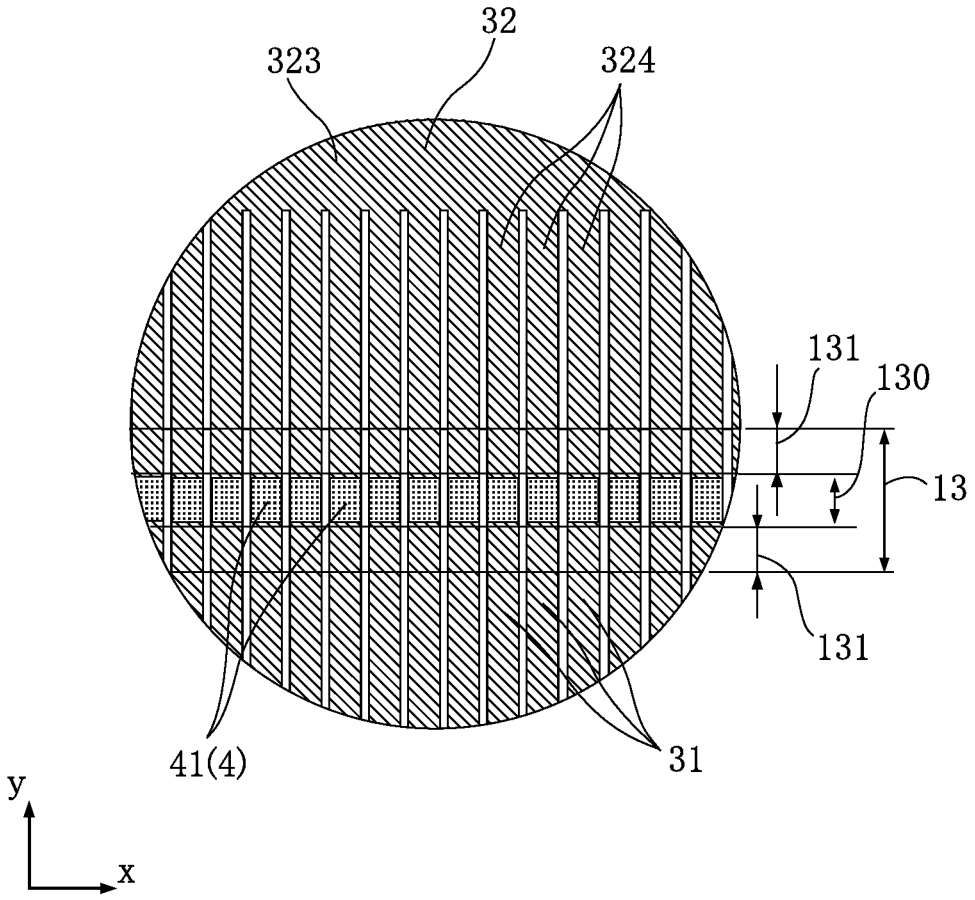
FIG. 3 is an enlarged plan view showing a part of a thermal print head according to one embodiment of the present disclosure.
Figure 4:
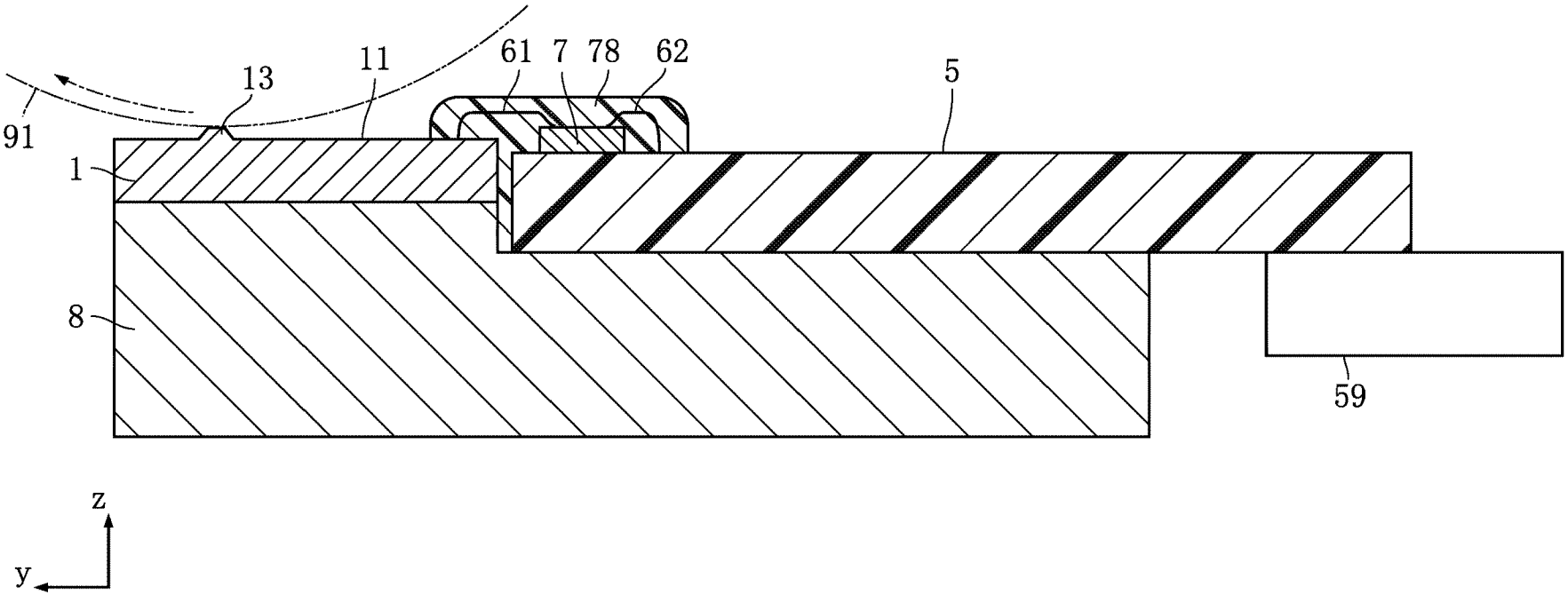
FIG. 4 is a sectional view taken along line IV-IV in FIG. 1.

Preferred embodiments of the present disclosure are described below with reference to the accompanying drawings.

FIGS. 1 to 6 show a thermal printhead according to one embodiment of the present disclosure. The thermal printhead A1 includes a head substrate 1, a connecting substrate 5 and a heat dissipating member 8. The head substrate 1 and the connecting substrate 5 are mounted on the heat dissipating member 8 and adjacent to each other in the sub-scanning direction y. The head substrate 1 is provided with a plurality of heat-generating parts 41 arranged side by side in the main-scanning direction x. The configuration of the heat-generating parts 41 will be described later. The heat-generating parts 41 are selectively driven by driver ICs 7 mounted on the connecting substrate 5 to generate heat according to an external printing signal received via a connector 59. As a result, the heat-generating parts 41 produce printing on a print medium such as thermal paper, which is pressed against the heat-generating parts 41 by a platen roller 91.

The head substrate 1 is elongated rectangular in plan view, with a length in the main scanning direction x and a width in the sub-scanning direction y. Although the dimensions of the head substrate 1 are not specifically limited, in one example, the substrate 1 measures 50 to 150 mm in the main scanning direction x, 2.0 to 5.0 mm in the sub-scanning direction y, and 725 μm in the thickness direction z. In the following description, the edge of the head substrate 1 closer to the driver ICs 7 in the sub-scanning direction y is referred to as an "upstream" side, whereas the edge farther from the driver ICs 7 in the sub-scanning direction y is referred to as a "downstream" side.

In the present embodiment, the head substrate 1 is made of a single-crystal semiconductor material. The single-crystal semiconductor material may preferably be Si. The head substrate 1 has a protrusion 13 formed integrally on its obverse surface 11 to extend in the main scanning direction x at a position closer to the downstream side. The protrusion 13 has a uniform cross section along the main scanning direction x.

Figure 5:
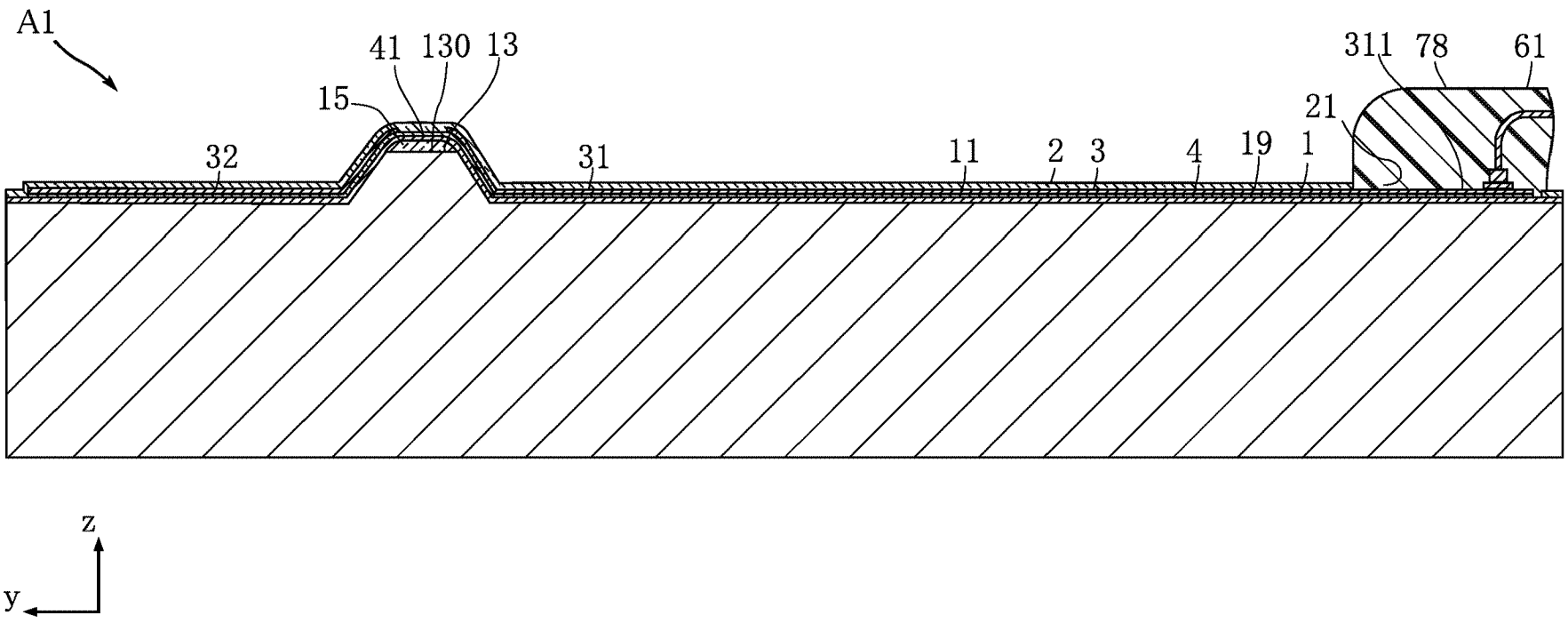
FIG. 5 is a plan view showing a part of a thermal print head according to one embodiment of the present disclosure.
Figure 6:
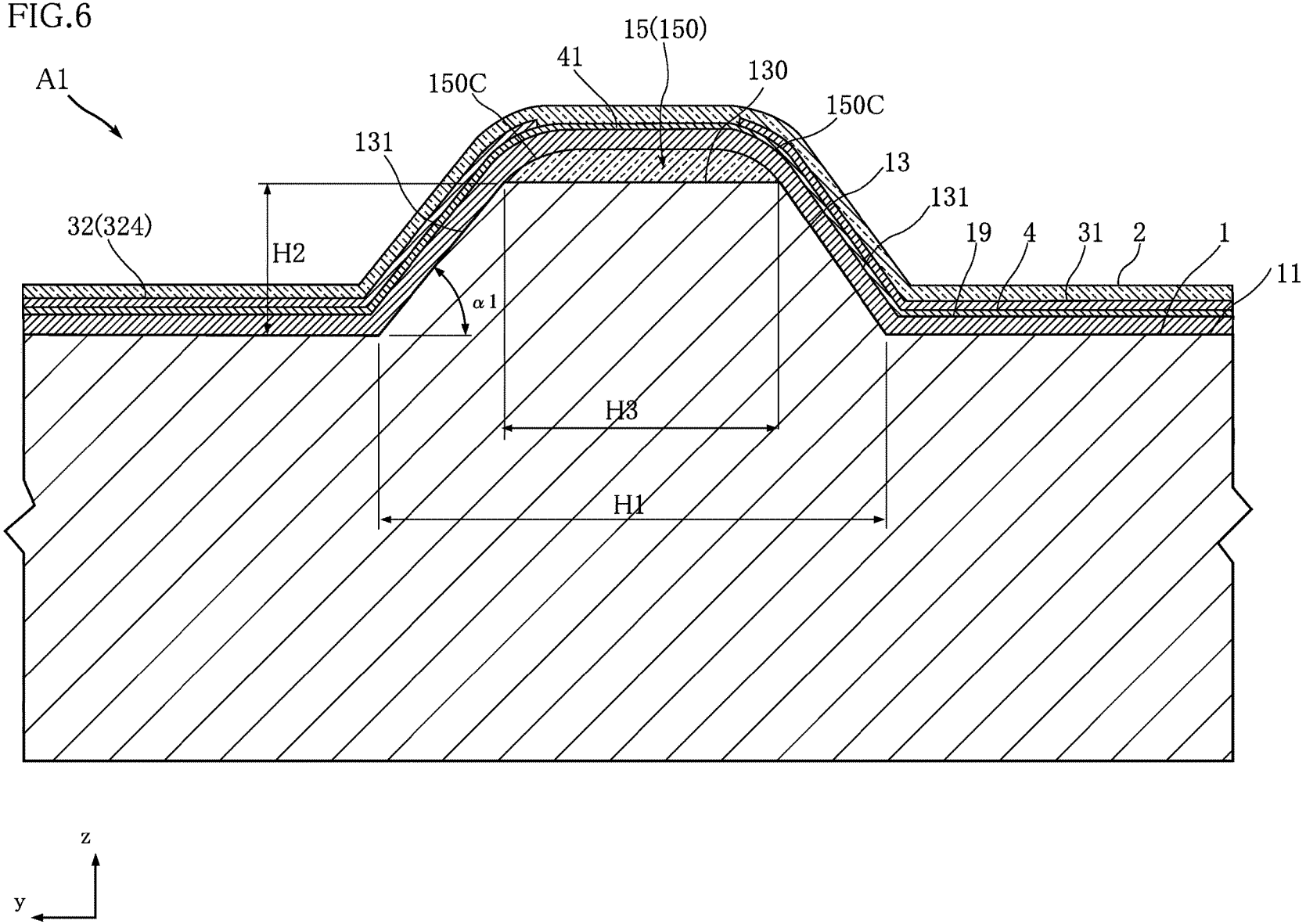
FIG. 6 is an enlarged plan view showing a part of a thermal print head according to one embodiment of the present disclosure.

As detailed in FIGS. 5 and 6, the protrusion 13 has a top surface 130 parallel to the obverse surface 11, and a pair of inclined outer surfaces 131 extending from the opposite ends of the top surface 130 in the sub-scanning direction y to the obverse surface 11. Specifically, the inclined outer surfaces 131 are inclined to the obverse surface 11, such that the height is lower with separation from the top surface 130 in the sub-scanning direction y. The inclination angle $\alpha l$ of the inclined outer surfaces 131 to the obverse surface 11 may be 50 to 60 degrees, for example. In the present embodiment, the protrusion 13 has a total width H1 of, for example, 200 to 300 μm in the sub-scanning direction y and a height H2 of, for example, 100 to 300 μm. The top surface 130 has a width H3 of, for example, 150 to 200 μm in the sub-scanning direction y. Note that the obverse surface 11 of the head substrate 1 and the top surface of the protrusion 13 are formed of a (100) plane (Miller index).

On the top surface 130 of the protrusion 13, a heat storage layer 15 is formed to extend in the main-scanning direction and covers the entire width of the top surface 130 in the sub-scanning direction y. According to the manufacturing method described below, the heat storage layer 15 is composed of a glaze part 150 formed by baking glass paste. The thickness of the heat storage layer 15 is about 10 to 200 μm, for example, and preferably 30 to 50 μm. As is shown in FIG. 6, the heat storage layer 15 has two ends spaced apart from each other in the sub-scanning direction, where each end is elongated in the direction x and has a rounded part 150C. With the rounded parts 150C, the surface of the heat storage layer 15 merges smoothly with the inclined outer surfaces 131 of the protrusion 13. According to the manufacturing method described below, the rounded parts 150C are formed after the formation of the protrusion 13, by baking an intermediate glaze 150B.

Additionally, to cover the obverse surface 11 of the head substrate 1 and the protrusion 13 having the heat storage layer 15 as described above, at least an insulating layer 19, a resistor layer 4, an electrode layer 3 and a protective layer 2 are formed in the stated order.

The insulating layer 19 covers the obverse surface 11 and the protrusion 13 of the head substrate 1. Specifically, the insulating layer 19 is formed to cover the region where the resistor layer 4 and the electrode layer 3 (described later) are to be formed. The insulating layer 19 is made of an insulating material such as $SiO_2$, SiN or TEOS (tetraethyl orthosilicate), for example. In the present embodiment, TEOS is suitably used. Although the thickness of the insulating layer 19 is not specifically limited, in one example, the thickness may be 5 to 15 μm or preferably 5 to 10 μm.

The resistor layer 4 covers the insulating layer 19, which covers the obverse surface 11 and the protrusion 13. The resistor layer 4 is made of TaN, for example. Although not limited to a specific thickness, the resistor layer 4 may have a thickness of, for example, 0.02 to 0.1 μm, or preferably about 0.08 μm. The resistor layer 4 has areas not covered by the electrode layer 3 (described later), and these exposed areas form a plurality of heat-generating parts 41. Most of the heat-generating parts 41 are arranged adjacent in the main-scanning direction x, and each heat-generating part covers the top surface 130 of the protrusion 13 entirely or partly in the secondary scanning direction y. In order to ensure that the heat-generating parts 41 are isolated from each other in the main-scanning direction x, at least in the area in the sub-scanning direction y where the heat-generating parts 41 are to be formed, the resistor layer 4 has parts that are spaced apart from each other in the main-scanning direction x.

The electrode layer 3 includes a plurality of individual electrode layers 31 formed in the upstream area of the head substrate 1, and a common electrode layer 32 formed in the downstream area of the head substrate 1. Each of the individual electrode layers 31 is in the form of a strip extending generally in the sub-scanning direction y and has a downstream end reaching an appropriate position on the protrusion 13. Each individual electrode layer 31 has an individual pad 311 at the upstream end. The individual pads 311 are connected by wires 61 to the driver ICs 7 mounted on the connecting substrate 5. The common electrode layer 32 has a plurality of teeth 324 and a common part 323 connecting the teeth 324. The common part 323 extends in the main scanning direction x along the upstream edge of the head substrate 1. The teeth 324 extend from the common part 323 in the form of strips in the secondary scanning direction y. Each of the teeth 324 has an upstream end located at an appropriate position on the protrusion 13 and faces the downstream end of the corresponding individual electrode layer 31 with a predetermined gap between them. The common part 323 has extensions 325 at the opposite ends of in the main scanning direction x. The extensions 325 bend in the sub-scanning direction y to reach the downstream side of the head substrate 1. The electrode layer 3 may be made of Cu and has a thickness of 0.3 to 2.0 μm, for example. As described earlier, the heat-generating parts 41 are composed of the parts of the resistor layer 4 that are located on the top surface of the protrusion 13 and not covered by the individual electrode layers 31 and the teeth 324 of the common electrode layer 32 facing the individual electrode layers 31.

The resistor layer 4 and the electrode layer 3 are covered by the protective layer 2. The protective layer 2 is made of an insulating material such as $SiO_2$, SiN, SiC, or AlN. The protective layer may have a thickness of 1.0 to 10 μm, for example.

As shown in FIG. 5, the protective layer 2 has a pad opening 21. The pad opening 21 exposes individual pads 311 of the individual electrode layers 31.

The connecting substrate 5 is arranged adjacent to the upstream side of the head substrate 1 in the sub-scanning direction y. The connecting substrate 5 may be a printed circuit board, and the driver ICs 7 and the connector 59 are mounted thereon. In plan view, the connecting substrate 5 is rectangular elongated in the main scanning direction x.

The driver ICs 7 are mounted on the connecting substrate 5 for selectively passing an electric current through the plurality of heat-generating parts 41. The driver ICs 7 are connected to the individual pads 311 of the individual electrode layers 31 via a plurality of wires 61. The driver ICs 7 are also connected to the wiring pattern on the connecting substrate 5 via wires 62. The driver IC 7 receives as input an external printing signal via the connector 59. In response to the printing signal, the heat-generating parts 41 are selectively energized to generate heat.

The driver ICs 7 and the wires 61 and 62 are covered by a protective resin 78 formed across the head substrate 1 and the connecting substrate 5. The protective resin 78 may be a black insulating resin, such as epoxy resin.

The heat dissipating member 8 supports the head substrate 1 and the connecting substrate 5 and dissipates a part of the heat generated by the heat-generating parts 41 to the outside. The heat dissipating member 8 may be made of a metal such as aluminum.

The following describes an example of a method for manufacturing a thermal printhead A1, with reference to FIGS. 7 to 17.

Figure 7:
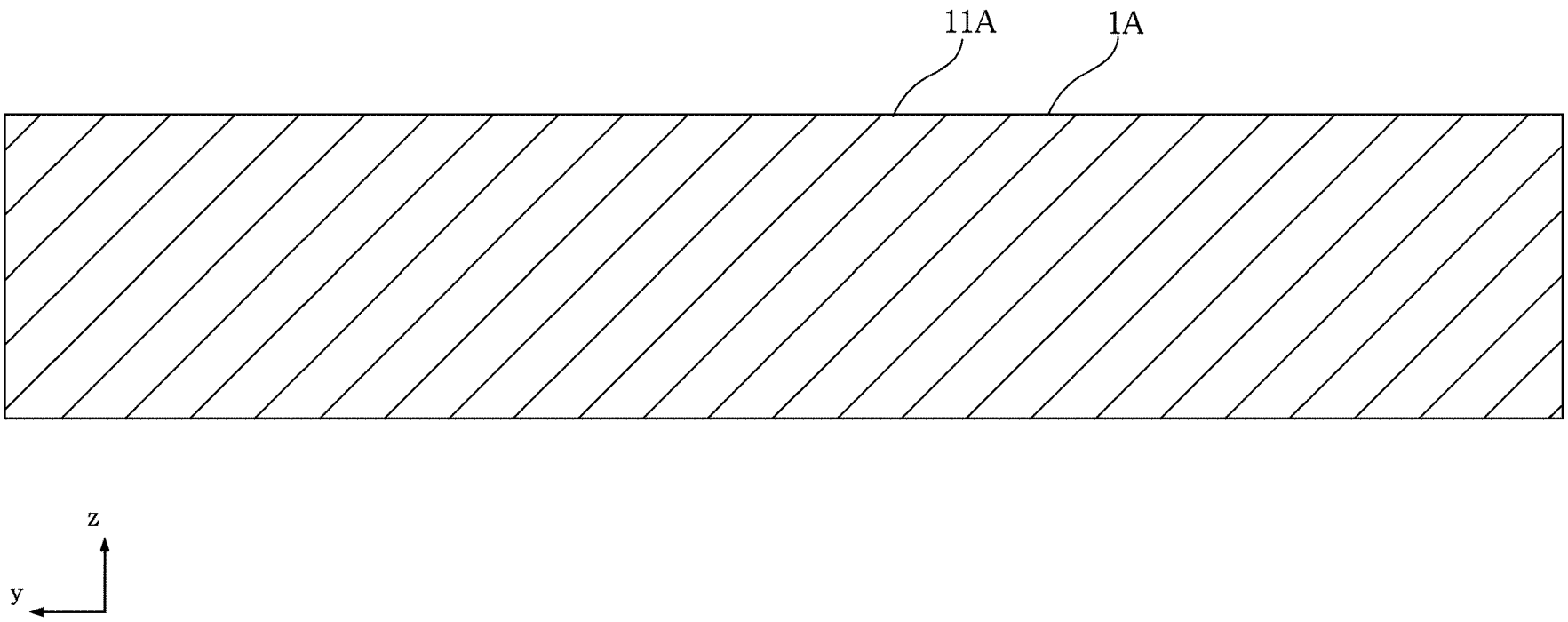
FIG. 7 is a sectional view showing an example of a method for manufacturing a thermal printhead according to one embodiment of the present disclosure.

First, a material substrate 1A is prepared, as shown in FIG. 7. The material substrate 1A is made of a single-crystal semiconductor and may be a Si wafer, for example. The material substrate 1A has a flat obverse surface 11A formed of a (100) plane.

Figure 8:
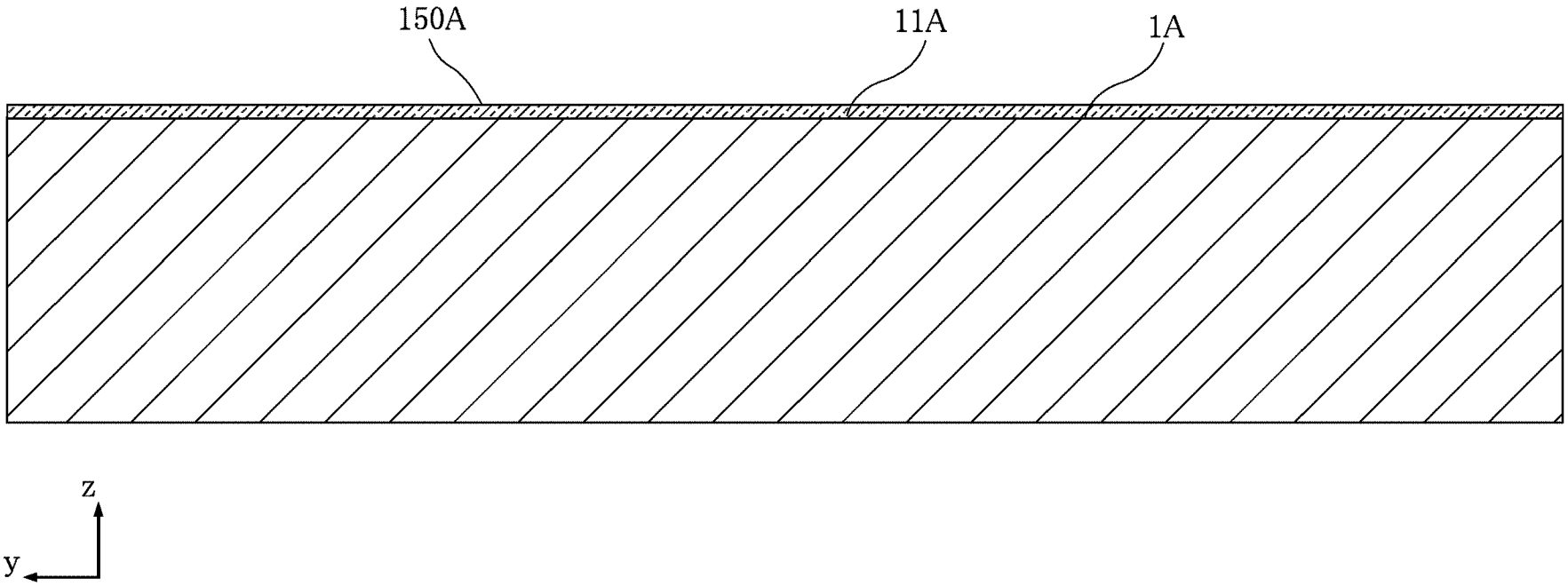
FIG. 8 is a sectional view showing an example of a method for manufacturing a thermal printhead according to one embodiment of the present disclosure.

Next, as shown in FIG. 8, glass paste is applied to the entire obverse surface 11A of the material substrate 1A by screen printing, followed by baking to form a glaze layer 150A. The glaze layer 150A may have a thickness of, for example, 10 to 200 μm, and preferably 30 to 50 μm.

Figure 9:
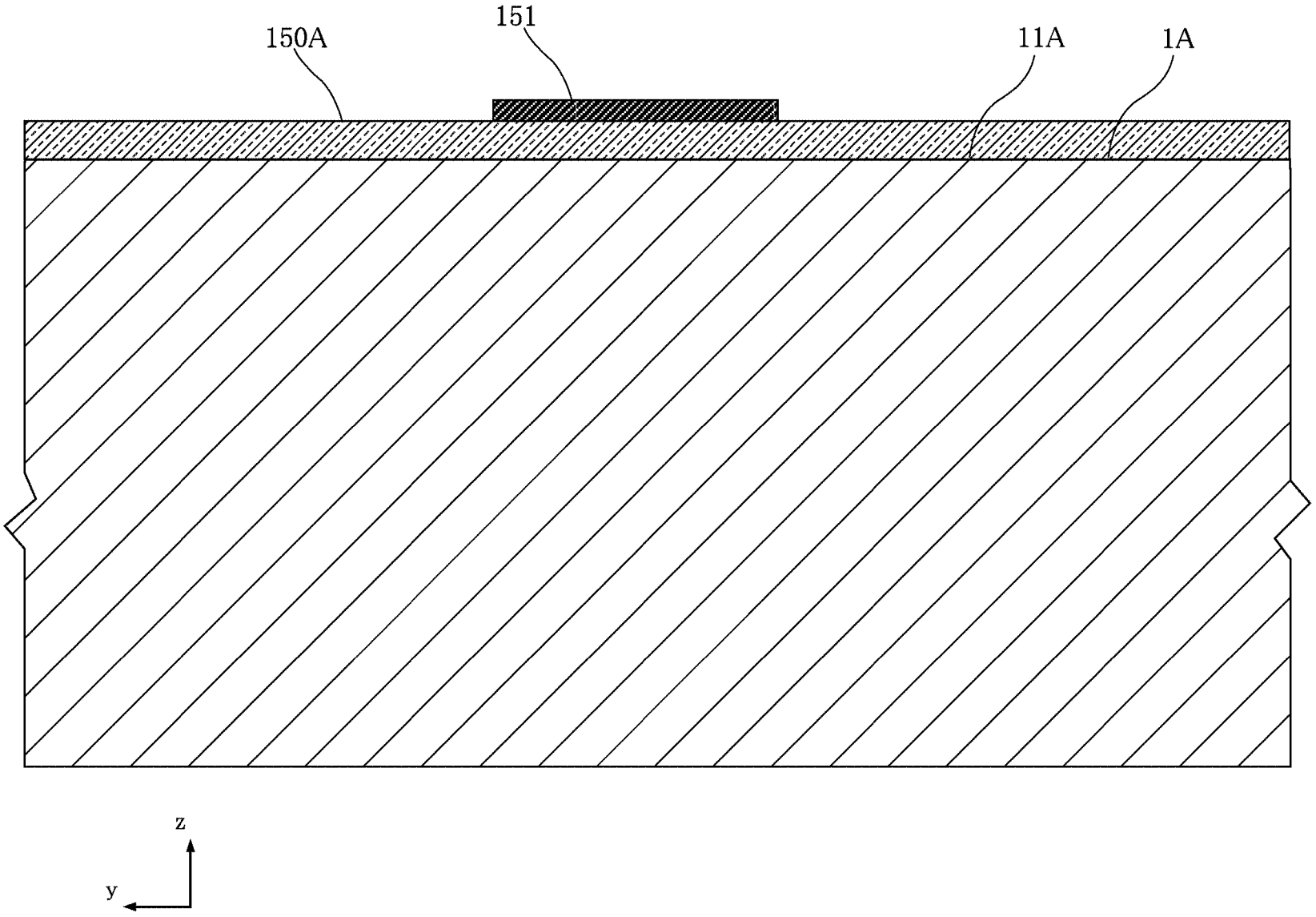
FIG. 9 is a sectional view showing an example of a method for manufacturing a thermal printhead according to one embodiment of the present disclosure.

Next, as shown in FIG. 9, a resist 151 is applied to the surface of the glaze layer 150A by, for example, photolithography to mask the area that will be the top surface 130 of the protrusion 13.

Figure 10:
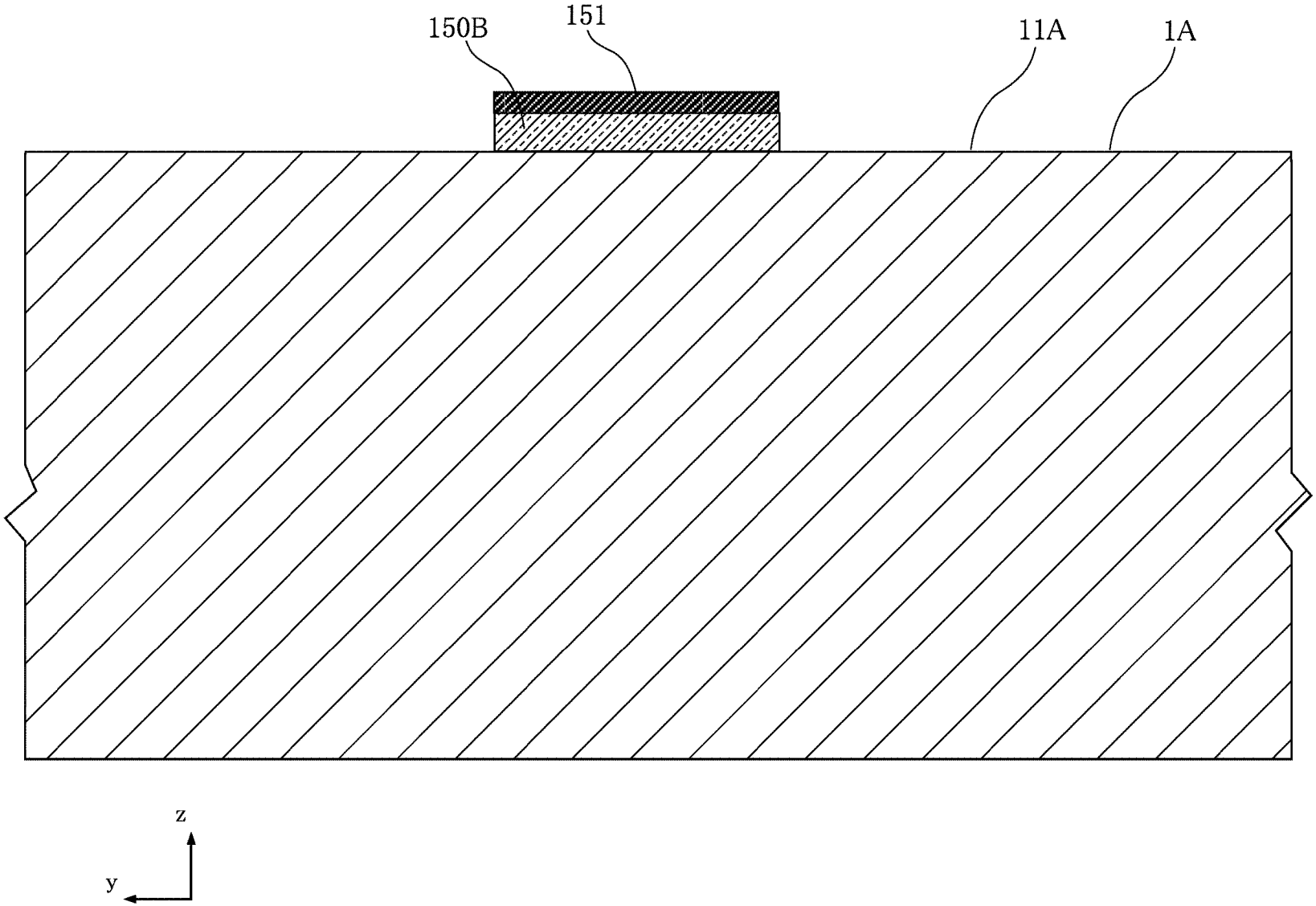
FIG. 10 is a sectional view showing an example of a method for manufacturing a thermal printhead according to one embodiment of the present disclosure.

Next, as shown in FIG. 10, the glaze layer is subjected to wet etching using the resist 151 as a mask. As a result, the area of the glaze layer not masked by the resist 151 is removed.

Figure 11:
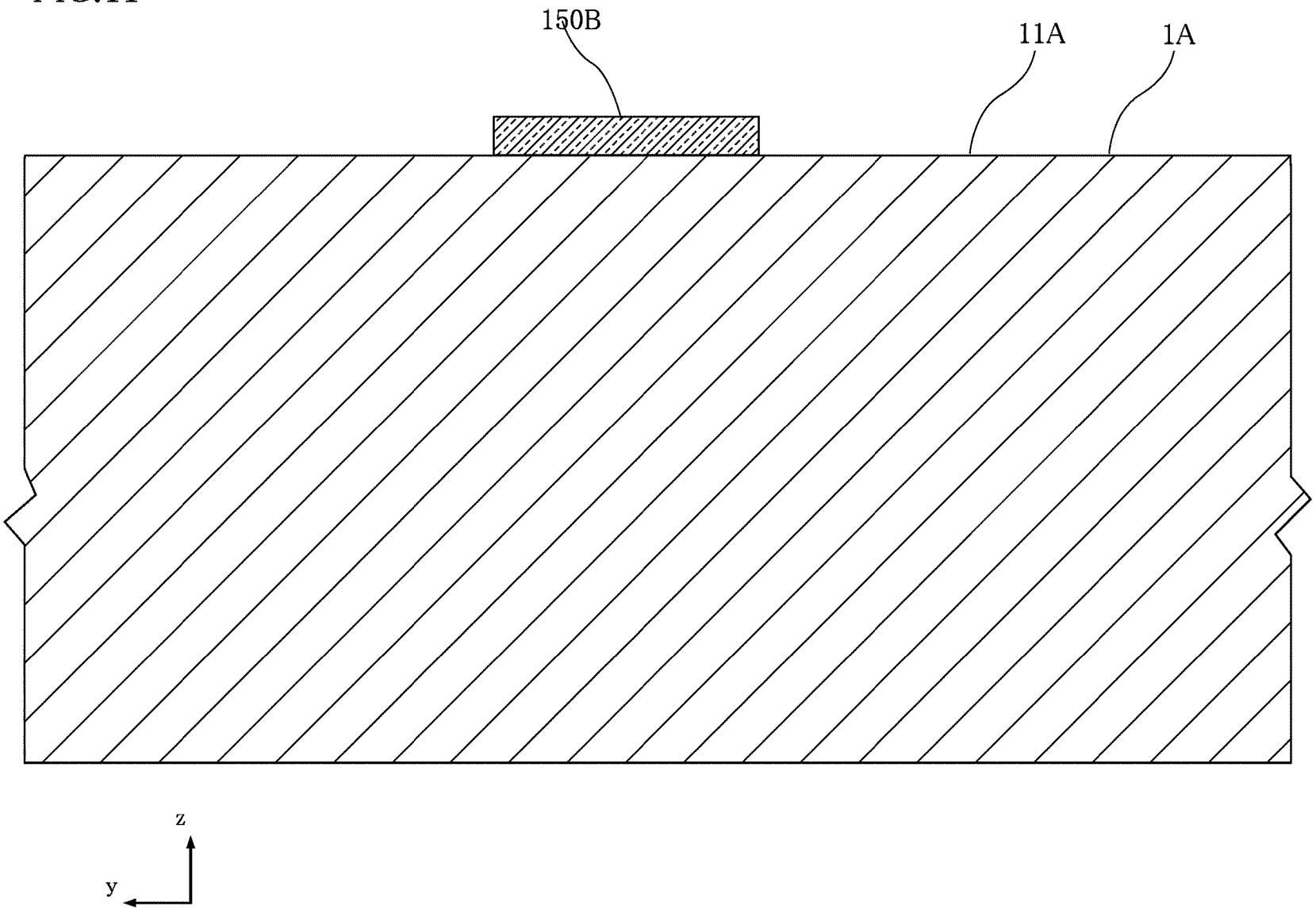
FIG. 11 is a sectional view showing an example of a method for manufacturing a thermal printhead according to one embodiment of the present disclosure.

Next, as shown in FIG. 11, the resist 151 is removed. The area of the glaze layer left unremoved form an intermediate glaze 150B on the top surface 130 of the protrusion 13 to be formed.

Figure 12:
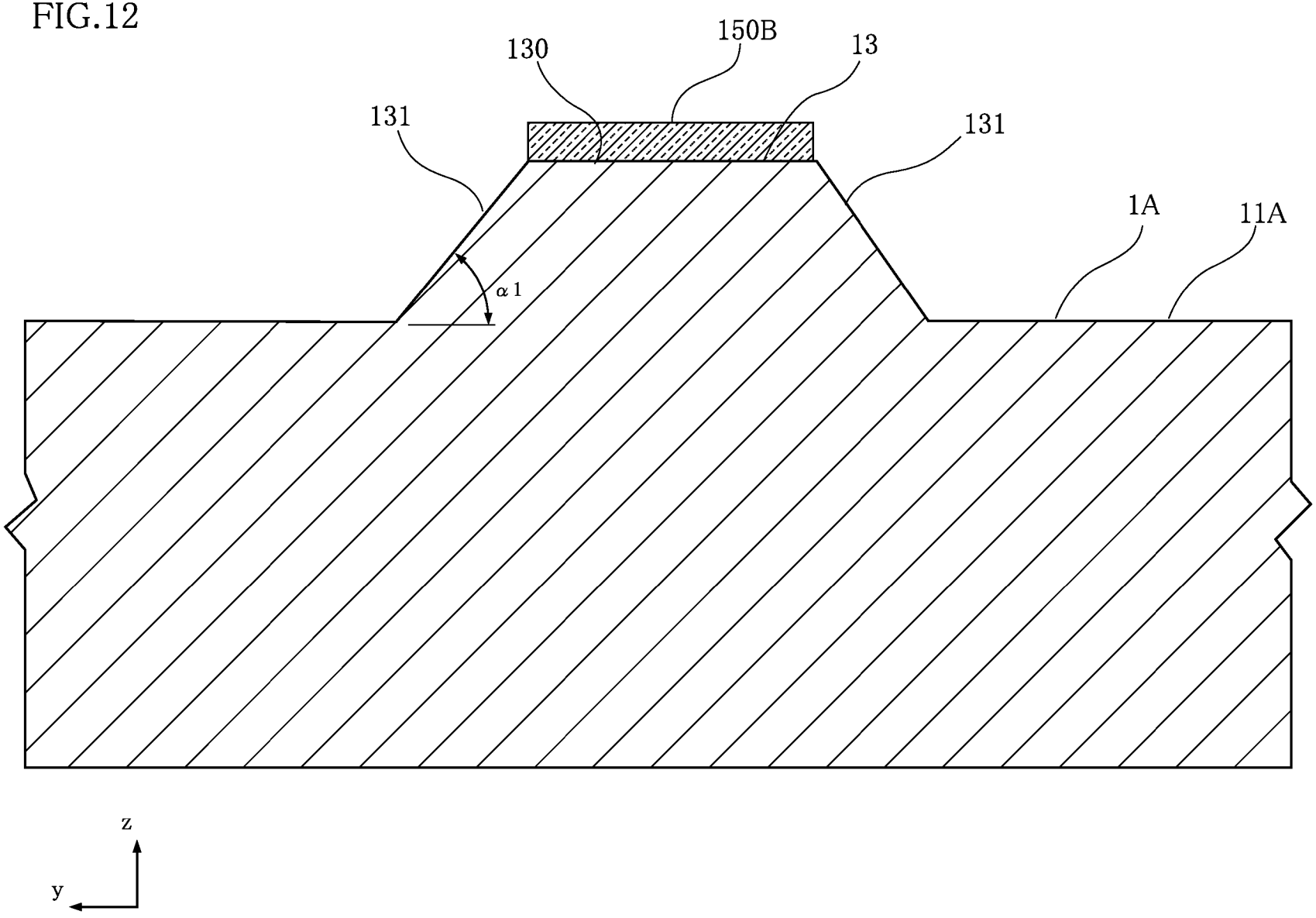
FIG. 12 is a sectional view showing an example of a method for manufacturing a thermal printhead according to one embodiment of the present disclosure.

Next, as shown in FIG. 12, the material substrate 1A is processed by anisotropic etching using, for example, KOH. In this process, the intermediate glaze 150B acts as a mask. In this way, the unremoved part forms the protrusion 13 having a substantially uniform cross section extending in the main-scanning direction x. As described earlier, the protrusion 13 has a top surface 130 and a pair of inclined outer surfaces 131 flanking the top surface 130 in the sub-scanning direction y. The inclined outer surfaces 131 extend obliquely downward from the edges of the top surface 130 in the sub-scanning direction y, such that the height is lower with a distance from the top surface 130 in the sub-scanning direction y. As mentioned earlier, the inclination angle of the inclined outer surfaces 131 to the obverse surface 11A is 50 to 60 degrees.

Figure 13:
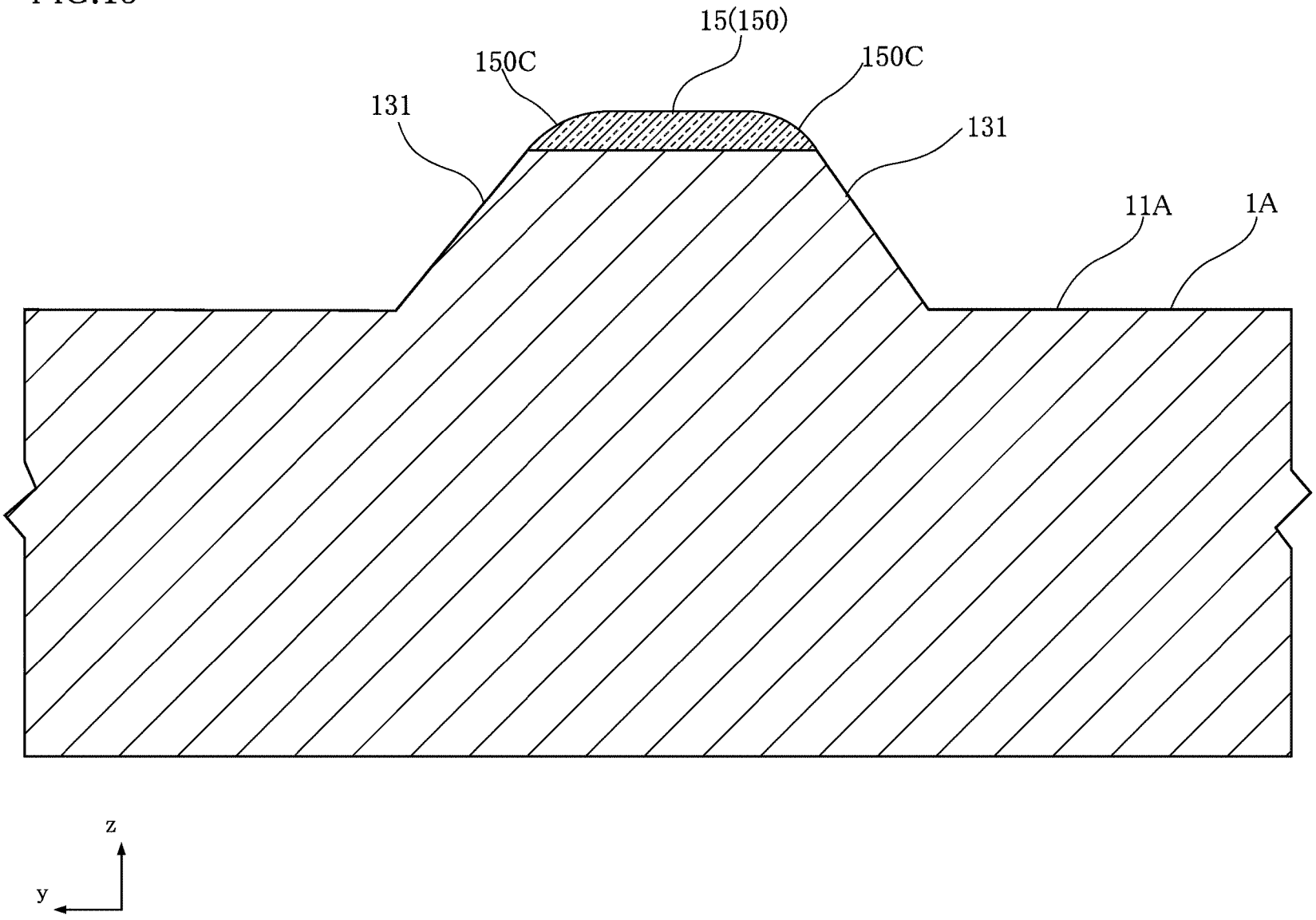
FIG. 13 is a sectional view showing an example of a method for manufacturing a thermal printhead according to one embodiment of the present disclosure.

Next, as shown in FIG. 13, the intermediate glaze 150B is baked to form rounded parts 150C at the ends in the sub-scanning direction. The surface of each rounded part 150C merges smoothly with the corresponding inclined outer surface 131 of the protrusion 13. In this way, the glaze part 150 having the rounded parts along the opposite ends in the sub-scanning direction is formed and serves as the heat storage layer 15.

Figure 14:
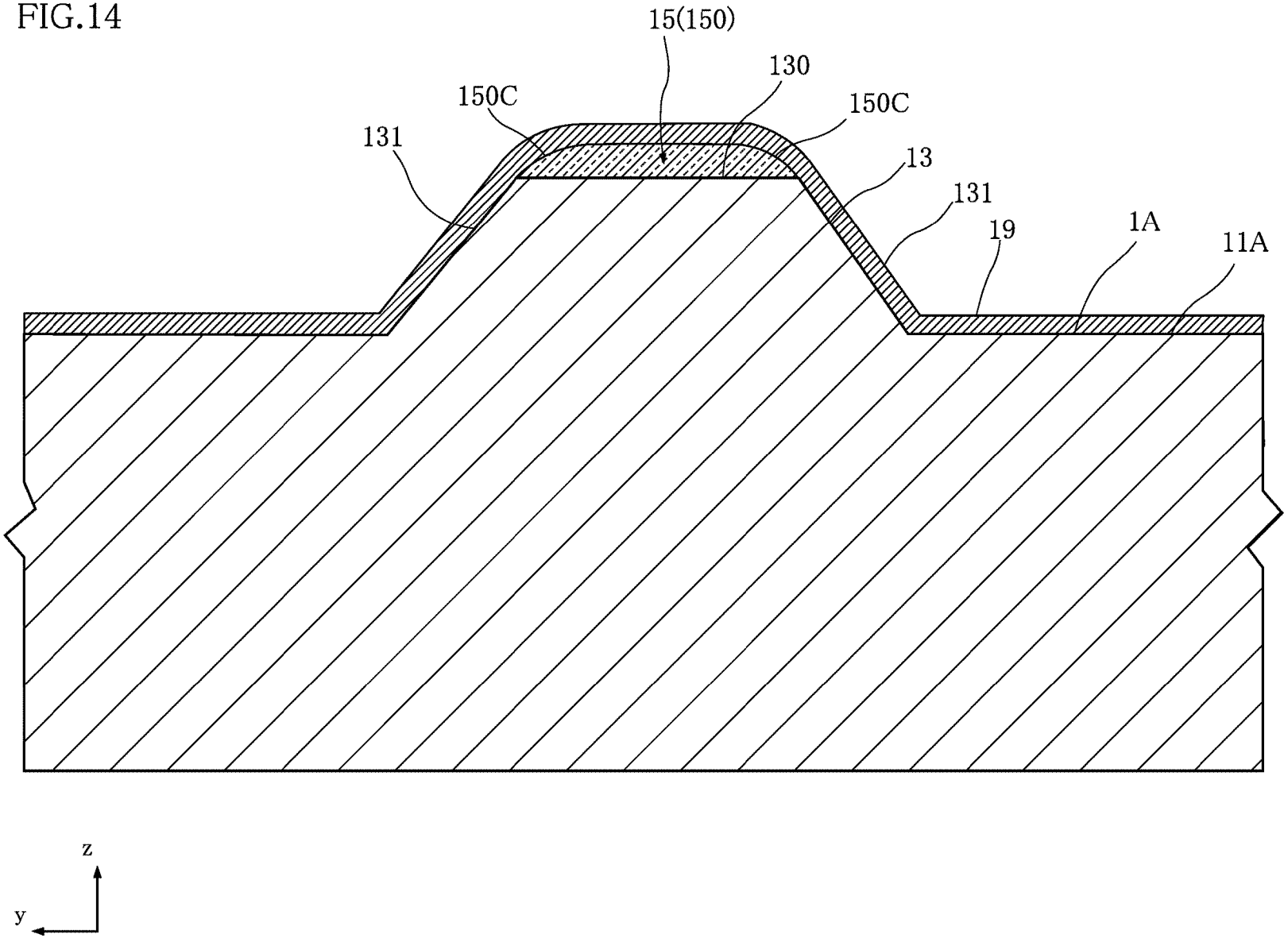
FIG. 14 is a sectional view showing an example of a method for manufacturing a thermal printhead according to one embodiment of the present disclosure.

Next, as shown in FIG. 14, an insulating layer 19 is formed. Specifically, the insulating layer 19 is formed, for example, by depositing TEOS through CVD.

Figure 15:
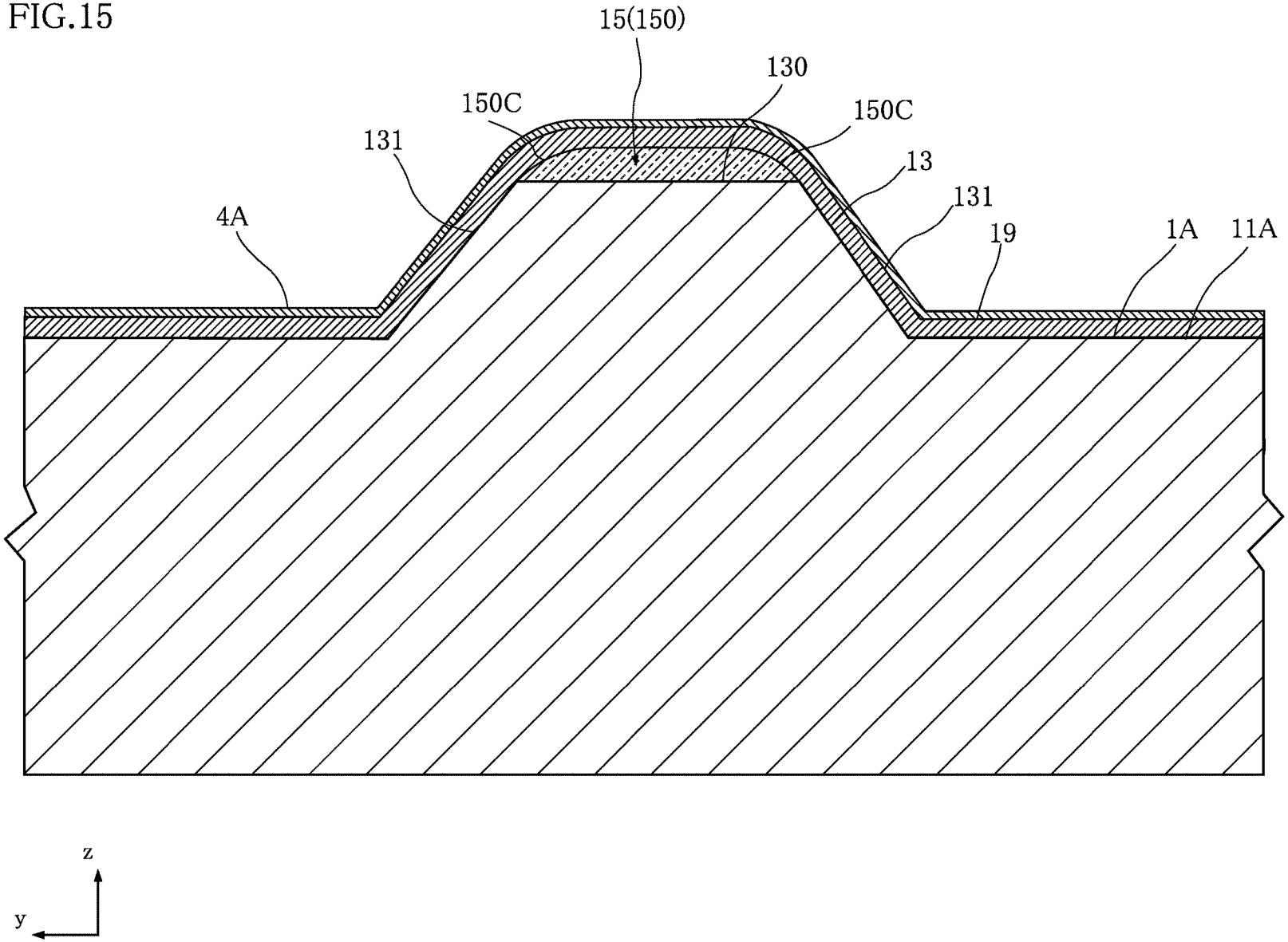
FIG. 15 is a sectional view showing an example of a method for manufacturing a thermal printhead according to one embodiment of the present disclosure.

Next, as shown in FIG. 15, a resistor film 4A is formed. Specifically, the resistor film 4A is formed, for example, by sputtering a thin layer of TaN on the insulating layer 19.

Figure 16:
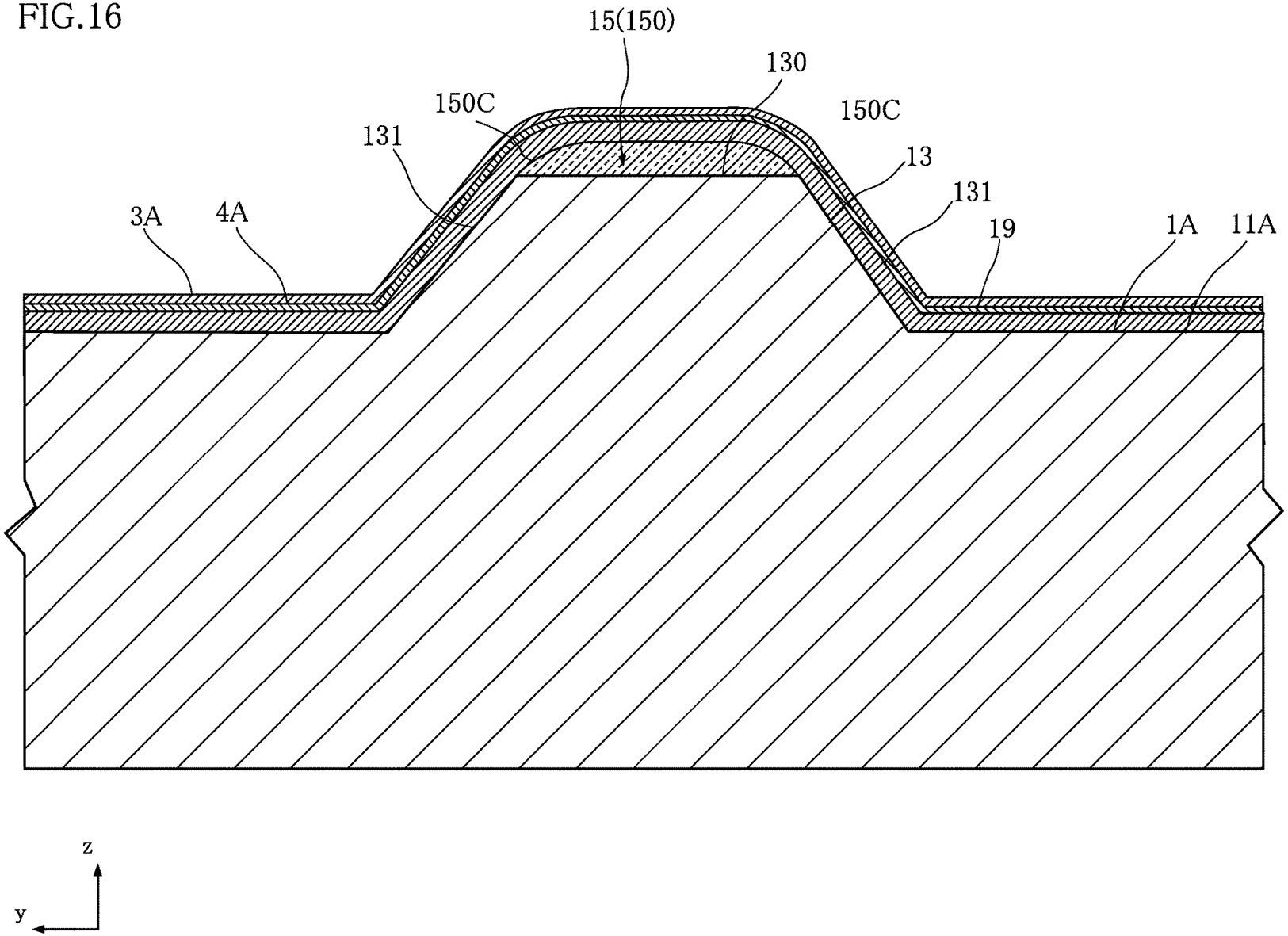
FIG. 16 is a sectional view showing an example of a method for manufacturing a thermal printhead according to one embodiment of the present disclosure.

Next, as shown in FIG. 16, a conductive film 3A is formed. Specifically, the conductive film 3A is formed, for example, by plating or sputtering a thin layer of Cu.

Figure 17:
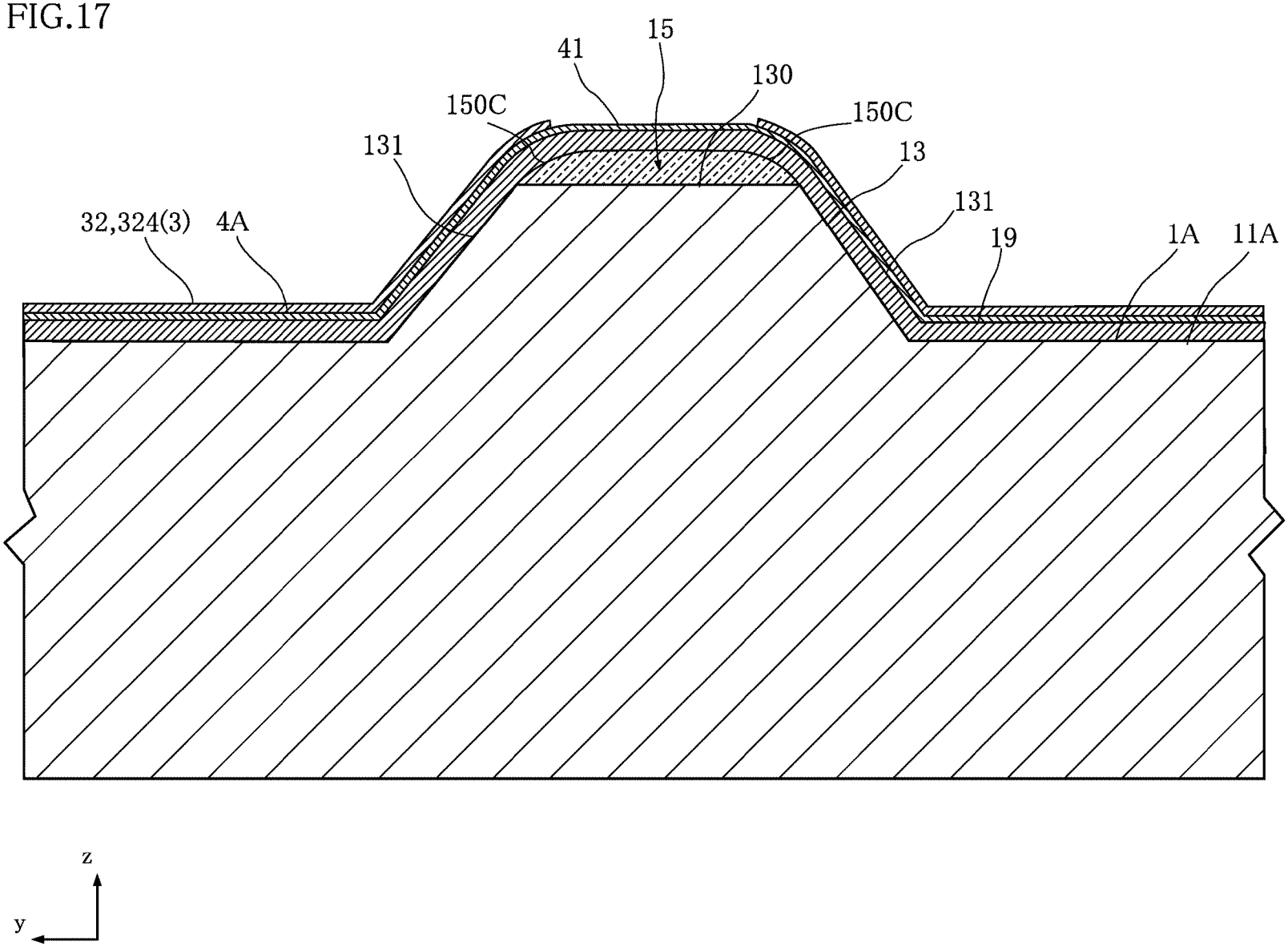
FIG. 17 is a sectional view showing an example of a method for manufacturing a thermal printhead according to one embodiment of the present disclosure.

Next, as shown in FIG. 17, the conductive film 3A and the resistor film 4A are selectively etched. As a result, a resistor layer 4 is formed with parts separated in the main scanning direction x. Also, individual electrode layers 31 and teeth 324 of the common electrode layer 32 are formed to cover the resistor layer 4 except where the heat-generating parts 41 are formed.

Next, a protective layer 2 (see FIG. 5) is formed. The protective layer 2 may be formed by depositing SiN and SiC on the insulating layer 19, the electrode layer 3 and the resistor layer 4 by CVD. The protective layer 2 is then partially removed by, for example, etching so as to form the pad opening 21. Thereafter, to obtain the thermal printhead A1 shown in FIGS. 1-6, the head substrate 1 and a connecting substrate 5 are attached to a heat dissipating member 8; driver ICs 7 are connected to the connecting substrate 5; wires 61 and 62 are bonded; and a protective resin 78 is formed.

The following describes advantages of the thermal printhead A1 according to the embodiment.

The heat-generating parts 41 are located on the top surface of the protrusion 13 formed on the head substrate 1. It is therefore easier to bring a print medium pressed by the platen roller 91 into contact with the heat-generating parts 41. Moreover, the protrusion is formed from a single-crystal semiconductor material by anisotropic etching and thus has a uniform cross section along the main scanning direction x.

This ensures that the pressure exerted on the print medium pressed against the heat-generating parts 41 is uniform along the main scanning direction x. These advantages hold true for the head substrates 1 of different production lots, which leads to improved printing quality.

The head substrate 1 is made of Si wafer, which has a relatively high thermal conductivity. Without suitable measures, a Si wafer would conduct too much heat generated by the heat-generating part 41 to the heat dissipating member 8, which makes the resulting thermal printhead unsuitable for high-speed printing. The thermal printhead A1, however, is provided with the heat storage layer 15 over the top surface of the protrusion 13. The heat storage layer 15 is formed of a glass glaze part 150 having a thickness of 10 to 200 μm and preferably of 30 to 50 μm and sufficiently reduces the conduction of heat generated by the heat-generating parts 41. The thermal printhead A1 is therefore suitable for high-speed printing.

Additionally, the heat storage layer 15 is formed over the top surface 130 of the protrusion 13 formed of Si, simply by subjecting the glaze layer 150A to wet etching. This process makes it possible to form a much thicker layer (with much less time) than by sputtering $SiO_2$. This also serves to improve the manufacturing efficiency and reduce cost of the thermal printhead A1.

The present disclosure is not limited to the specific embodiment described above. Rather, the present disclosure covers any modifications and variations made within the scope of the claims.

For example, the heat-generating parts 41 may have any other configuration as long as the heat-generating parts can be driven to generate heat by selectively passing an electric current through the exposed parts of the resistor layer isolated from each other in the main-scanning direction x.

The invention claimed is:

1. A thermal printhead comprising:

a substrate having an obverse surface;

a protrusion formed on the obverse surface of the substrate and extending in a main scanning direction;

a heat storage layer formed on a top surface of the protrusion; and a plurality of heat-generating parts arranged along the main scanning direction on the heat storage layer, wherein the substrate and the protrusion are integrally formed from a single-crystal semiconductor, the heat storage layer has a bottom surface that extends over an entire width of the top surface of the protrusion in a sub-scanning direction, the protrusion has a pair of inclined outer surfaces extending from ends of the top surface in the sub-scanning direction to the obverse surface, and the heat storage layer has an outer surface opposite to the bottom surface, the outer surface connecting directly to the inclined outer surfaces in the sub-scanning direction.

2. The thermal printhead according to claim 1, further comprising a resistor layer, an upstream conductive layer and a downstream conductive layer, wherein the upstream conductive layer and the downstream conductive layer are formed on the resistor layer so as to expose parts of the resistor layer and be electrically connected to each other, and wherein the plurality of heat-generating parts correspond to the exposed parts of the resistor layer.

3. The thermal printhead according to claim 1, wherein the single-crystal semiconductor is made of Si, and the obverse surface is formed of a (100) plane.

4. The thermal printhead according to claim 3, wherein the protrusion has a height of 100 to 300 μm with respect to the obverse surface, and the heat storage layer has a maximum thickness of 10 to 200 μm.

5. The thermal printhead according to claim 4, wherein the top surface of the protrusion is flat and parallel to the obverse surface, and the heat storage layer comprises a glaze part formed of a baked glass paste.

6. The thermal printhead according to claim 5, wherein the inclined outer surfaces are inclined to be lower with increasing distance from the top surface in the sub-scanning direction, and the glaze part has an upper surface with edges spaced apart in the sub-scanning direction, the edges being connected to the inclined outer surfaces, respectively, via rounded parts.

7. A method for manufacturing a thermal printhead comprising: a substrate having an obverse surface; a protrusion formed on the obverse surface of the substrate and extending in a main scanning direction; a heat storage layer formed on a top surface of the protrusion; and a plurality of heat-generating parts arranged along the main scanning direction on the heat storage layer, the substrate and the protrusion being integrally formed from a single-crystal semiconductor, the method comprising:

forming a glaze layer of a predetermined thickness on an obverse surface of a material substrate of a single-crystal semiconductor;

forming an intermediate glaze by subjecting the glaze layer to wet-etching, the intermediate glaze having a predetermined width in a sub-scanning direction and extending in the main scanning direction; and forming the protrusion by anisotropic etching of the material substrate in a manner such that the protrusion has a top surface covered by the intermediate glaze.

8. The method according to claim 7, wherein the material substrate is an Si wafer having a (100) plane as the obverse surface.

9. The method according to claim 7, wherein the forming of the glaze layer comprises printing and baking a glass paste.

10. The method according to claim 7, wherein the forming of the protrusion comprises using the intermediate glaze as a mask.

11. The method according to claim 10, wherein the forming of the protrusion comprises anisotropic etching by using KOH.

12. The method according to claim 11, wherein the forming of the protrusion comprises forming a pair of inclined outer surfaces connected to respective ends of the top surface that are spaced apart in the sub-scanning direction, the inclined outer surfaces being inclined with respect to the obverse surface so as to be lower with increasing distance from the top surface in the sub-scanning direction.

13. The method according to claim 11, further comprising baking the intermediate glaze after the forming of the protrusion, so that the intermediate glaze has rounded parts at ends of an upper surface spaced apart in the sub-scanning direction and the rounded parts are connected to the inclined outer surfaces, respectively.

14. The method according to claim 7, wherein the glaze layer has a thickness of 10 to 200 μm.

15. The method according to claim 7, wherein the protrusion has a height of 100 to 300 μm.

16. The method according to claim 7, further comprising forming the plurality of heat-generating parts after the forming of the protrusion, wherein the forming of the plurality of heat-generating parts comprises: forming a resistor layer; and forming an upstream conductive layer and a downstream conductive layer that overlap with the resistor layer and also expose a plurality of parts of the resistor layer.

* * * * *